US010830549B1

(12) United States Patent
Facteau et al.

(10) Patent No.: US 10,830,549 B1
(45) Date of Patent: Nov. 10, 2020

(54) HANDLE AND FIRING MECHANISM ASSEMBLY

(71) Applicant: U.S. Government as Represented by the Secretary of the Army, Dover, NJ (US)

(72) Inventors: Robert J. Facteau, Troy, NY (US); George E. Hathaway, IV, Watervliet, NY (US); Brett L. Stewart, Schenectady, NY (US); Zachary P. Jablonka, Niskayuna, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/434,296

(22) Filed: Jun. 7, 2019

Related U.S. Application Data

(60) Provisional application No. 62/690,437, filed on Jun. 27, 2018.

(51) Int. Cl.
*F41A 19/29* (2006.01)
*F41F 1/06* (2006.01)

(52) U.S. Cl.
CPC ..... *F41A 19/29* (2013.01); *F41F 1/06* (2013.01)

(58) Field of Classification Search
CPC ..... F41A 17/64; F41A 19/00; F41A 19/06; F41A 19/10
See application file for complete search history.

(56) References Cited

U.S. PATENT DOCUMENTS

| | | | | |
|---|---|---|---|---|
| 2,477,253 | A | 7/1949 | Jasse | |
| 2,503,309 | A | 4/1950 | Weiss | |
| 3,074,322 | A | 1/1963 | Jasse | |
| 3,782,240 | A * | 1/1974 | Feldmaier | F41A 17/64 89/1.35 |
| 4,709,614 | A | 12/1987 | Klumpp | |
| 4,744,283 | A | 5/1988 | Ibarra | |
| 6,851,348 | B1 | 2/2005 | Ang | |
| 10,386,144 | B1 * | 8/2019 | Facteau | F41F 1/06 |

FOREIGN PATENT DOCUMENTS

| | | |
|---|---|---|
| GB | 146901 | 10/1921 |

* cited by examiner

*Primary Examiner* — J. Woodrow Eldred
(74) *Attorney, Agent, or Firm* — John P. DiScala

(57) ABSTRACT

A Handle and Firing Mechanism Assembly (H&FMA) provides a robust and streamlined H&FMA for a mortar weapon system. The H&FMA is easier to assemble and eliminates jamming issues, and firing pin protrusion adjustment procedures. It also incorporates a lighter trigger squeeze in Trigger fire mode and locks the firing pin in Drop fire mode. The handle is easier and more cost effective to produce. The H&FMA can be used with, for example, a 60 mm mortar weapon system.

16 Claims, 7 Drawing Sheets

HANDLE AND FIRING MECHANISM ASSEMBLY

CROSS-REFERENCE TO RELATED APPLICATIONS

This application claims the benefit under 35 USC § 119(e) of U.S. provisional patent application 62/690,437 filed on Jun. 27, 2018.

STATEMENT OF GOVERNMENT INTEREST

The inventions described herein may be manufactured, used and licensed by or for the United States Government.

FIELD OF THE INVENTION

The invention relates in general to mortar weapon systems and in particular to firing mechanisms for mortar weapon systems.

BACKGROUND OF THE INVENTION

Mortars are indirect fire weapons which launch rounds in high arc ballistic trajectories to defeat enemy troops, materiel, bunkers and other infantry-type targets. Mortars typically comprise a cannon fixed to a base plate with a mounting structure. Mortars are muzzle loaded and rounds are fired by contact with a firing pin which may be fixed at the base of the mortar cannon or selectively put in contact by a firing mechanism.

There are performance issues with conventional mortar firing mechanisms, particularly handle and firing mechanisms for mortar weapons in the 60 mm caliber size. Due to the design of some currently available firing mechanisms, stack-up tolerances on assembled components can cause low firing pin protrusion into the cannon. During firing and after normal wear and tear it can fall below the minimum firing pin protrusion in a short amount of time. A low protruding firing pin can cause misfires resulting in loss of effectiveness and possible injury or fatalities. Mounting adjustments and occasional readjustments after repeated use are often necessary to obtain sufficient firing pin protrusion.

In addition, the selector switch which places the mortar in different firing configurations is subject to wear and misalignment. This causes the selector switch to jam, slip out of drop fire mode and causes further reduced firing pin protrusion. Each of these issues can be catastrophic to a soldier.

Finally, there are issues with the handle housing cracking after use. This is caused by design induced stress areas and the amount of force required to fire the firing mechanism.

A need exists for a handle and firing mechanism for a mortar system which ensures proper firing pin protrusion, has an effective selector and is less prone to cracking.

SUMMARY OF INVENTION

One aspect of the invention is a handle and firing mechanism assembly for a mortar system capable of operating in a drop fire mode, a trigger fire mode and a safe mode. The handle and firing mechanism assembly comprises a handle housing, a trigger, a pivot assembly, a sear assembly and a selector. The trigger assembly protrudes from the handle housing and further comprises a trigger for receiving a rotational input from a user. The pivot assembly comprises a pivot which defines a hole extending through the pivot for receiving the trigger through and a trigger spring for biasing the trigger in an unrotated position. The sear assembly engages with the trigger for transferring a rotational translation of the trigger to a linear translation of a driver thereby causing a firing pin to protrude into a cannon. The sear assembly further comprises a driver, a hammer and a firing pin. The driver houses a pre-loaded die spring and defines an opening in an exterior surface within which a tip of the trigger rests. The hammer is in contact with an aft portion of the die spring and is pushed downward upon a release of the die spring. The firing pin lever is pivoted outward by the downward moving hammer with the firing pin lever in contact with a firing pin such that when outwardly pivoted, the firing pin is driven forward. The selector places the firing mechanism assembly in either the drop fire mode, the trigger fire mode or the safe mode by selectively restricting movement of the trigger. When the selector is placed in the drop fire mode, the selector is rotated to a position where the selector engages with a first feature of the driver such that the driver is restrained in a driven position.

Another aspect of the invention is a handle and firing mechanism assembly for a mortar system capable of operating in a drop fire mode, a trigger fire mode and a safe mode. The handle and firing mechanism assembly comprises a handle housing, a trigger, a pivot assembly, a sear assembly and a selector. The handle housing has a tubular grip and the rear base of the handle housing is fixably mounted to the cannon. The trigger protrudes from the handle housing and further comprises a trigger for receiving a rotational input from a user. The trigger comprises a spherical tip. The pivot assembly comprises a pivot which defines a hole extending through the pivot for receiving the trigger through and a trigger spring for biasing the trigger in an unrotated position. The sear assembly engages with the trigger for transferring a rotational translation of the trigger to a linear translation of a driver thereby causing a firing pin to protrude into a cannon. The sear assembly further comprises a driver, a hammer, a firing pin lever, a first link and a second link. The driver houses a pre-loaded die spring and defines an opening in an exterior surface within which the spherical tip of the trigger rests. The hammer is in contact with an aft portion of the die spring and is pushed downward upon a release of the die spring. The firing pin lever is pivoted outward by the downward moving hammer with the firing pin lever in contact with a firing pin such that when outwardly pivoted, the firing pin is driven forward. The first link and a second link rest over center against the handle housing with the aid of a torsion spring. The first link and second link are positioned within the sear assembly to restrain the hammer against a force of the die spring until the first link and the second link are pushed inward by the downward moving driver. The selector places the firing mechanism assembly in either the drop fire mode, the trigger fire mode or the safe mode by selectively restricting movement of the trigger. When the selector is placed in the drop fire mode, the selector is rotated to a position where the selector engages with a first feature of the driver such that the driver is restrained in a driven position.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A Handle and Firing Mechanism Assembly (H&FMA) provides a robust and streamlined handle and firing mechanism for a mortar weapon system. The H&FMA allows the user to select among three operating modes: trigger fire mode, drop fire mode and safe mode. The H&FMA can be used with mortar weapons, such as a 60 mm mortar weapon system. The H&FMA is easier to assemble and eliminates jamming issues, and firing pin protrusion adjustment procedures. It also incorporates a lighter trigger squeeze in Trigger fire mode and locks the firing pin in Drop fire mode. The handle is easier and more cost effective to produce.

The H&FMA incorporates a streamline handle design which significantly reduces the likelihood of cracking. The H&FMA has a non-adjustable, direct bolt-on assembly to ensure sufficient firing pin protrusion and eliminate the need for adjustments. In drop fire mode, the firing pin is held forward by a die spring when to further ensure firing pin protrusion. The selector switch contains a hard stop to prevent jamming and contains a lock to prevent slipping out of drop fire mode.

While the firing mechanism is described throughout as being employed on a 60 mm mortar system, the firing mechanism is not limited to use on a 60 mm mortar system and may be employed on a mortar system of a different size, such as a 120 mm or 81 mm mortar system. Further, the firing mechanism is not limited to only mortar weapon systems and may be utilized on any system which requires a firing mechanism and allows for operation in a trigger mode and a drop fire mode.

Figure 1:
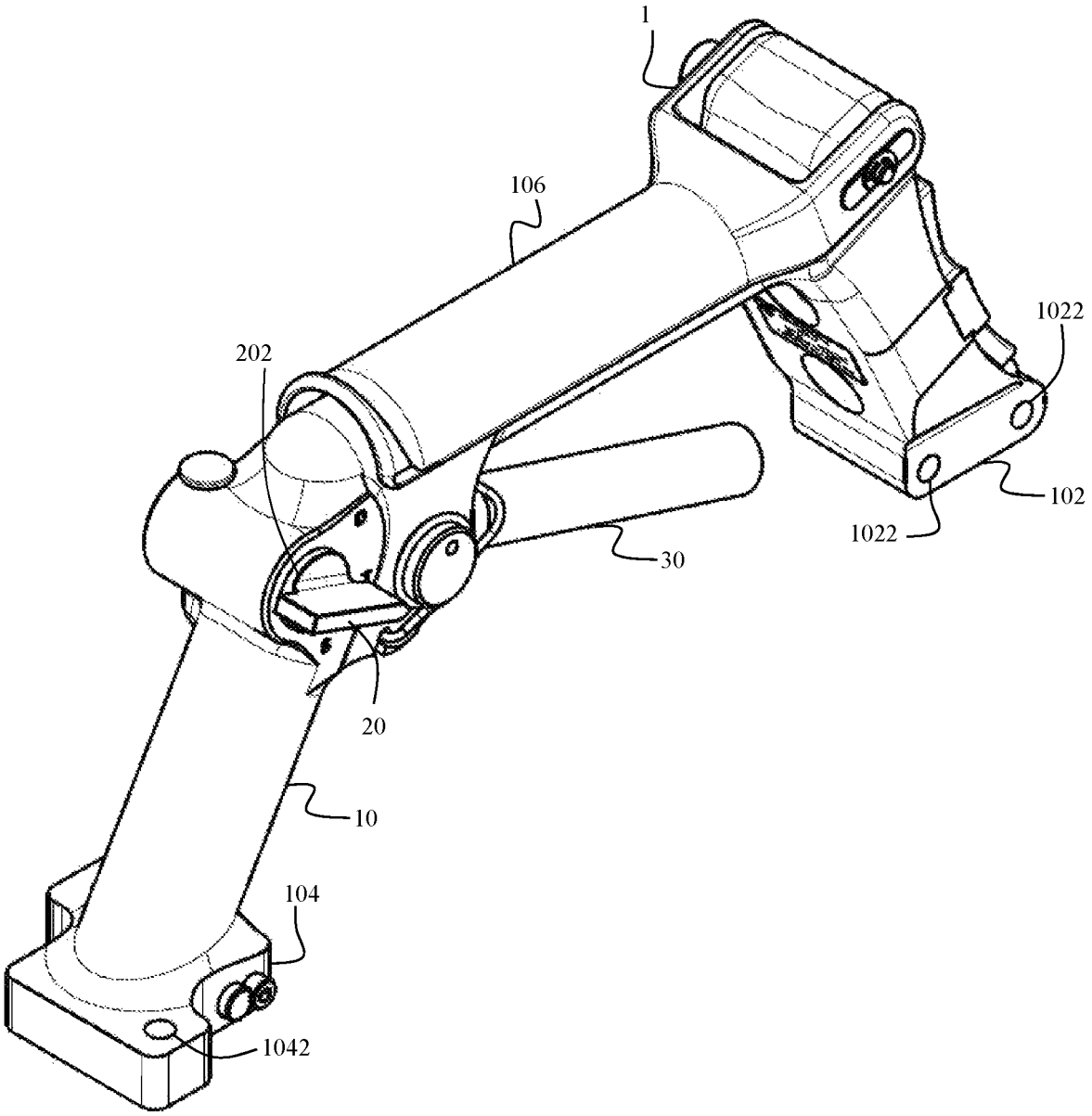
FIG. 1 is a perspective view of a handle and firing mechanism assembly in a released configuration, according to an illustrative embodiment.

FIG. 1 is a perspective view of a handle and firing mechanism assembly in a released configuration, according to an illustrative embodiment. The H&FMA 1 is housed in the main body called the handle 10. The handle 10 is mounted to an external surface of the cannon. A front base 102 of the handle 10 comprises mounting holes 1022 for receiving a mounting collar which extends around an exterior circumference of the cannon. A rear base 104 of the handle 10 comprises mounting holes 1042 for direct mounting to a base cap of the mortar cannon. The rear base of the handle 10 is hard mounted to the mortar system with no need for adjustment, to which the prior solutions require. As will be described further below, in operation, a die spring in the sear assembly has enough force when loaded to establish a seal from the firing gasses and maintain the best possible firing pin protrusion.

The handle 10 has a tubular grip 106 and rounded features to eliminate stress cracking to which prior solutions are prone to have. The handle 10 in the grip location also has a lower stance due to a redesigned sear assembly having a shorter tripping distance, than the prior solutions.

Figure 2:
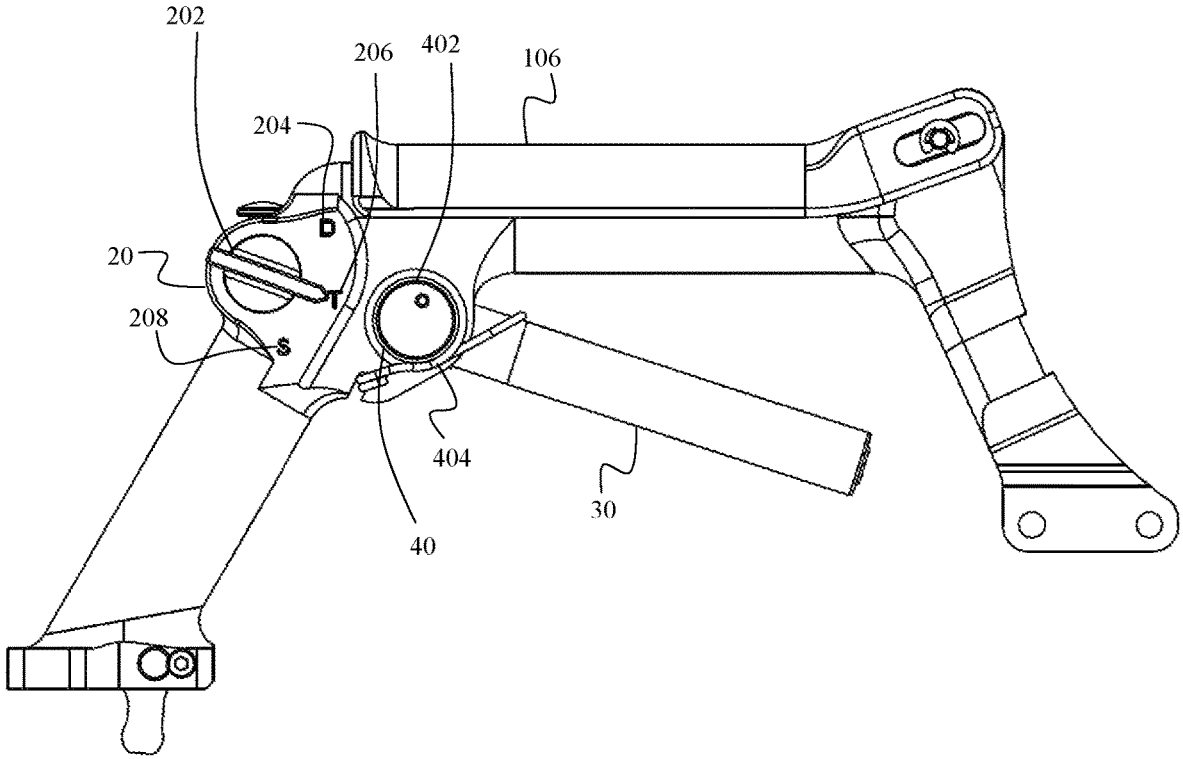
FIG. 2 is a side view of the handle and firing mechanism assembly, according to an illustrative embodiment.

FIG. 2 is a side view of the handle and firing mechanism assembly, according to an illustrative embodiment. The H&FMA 1 has three operating modes—drop fire (D) mode, trigger fire (T) mode and safe (S) mode. A user selects among the modes via a selector assembly 20 comprising a selector 202 protruding through the case 20. The selector 202 is rotated to one of three positions 204, 206, 208, each corresponding to an operating mode, with a label 222 indicating which mode is being selected. As will be shown in further detail below, the selector 202 is held in place by a compression spring and ball pressing against one of three detent grooves in the selector 202.

When the selector 202 is placed in trigger fire mode, the trigger 30 is able to rotate through a firing sequence of engagement and release. To place the selector 202 in drop fire mode, the trigger 30 is first engaged and then the selector 202 is rotated to the drop fire position 204. Once in drop fire mode, the trigger 30 is restrained from returning to the released position. In safe mode, the trigger 30 is prevented from being engaged.

Figure 3:
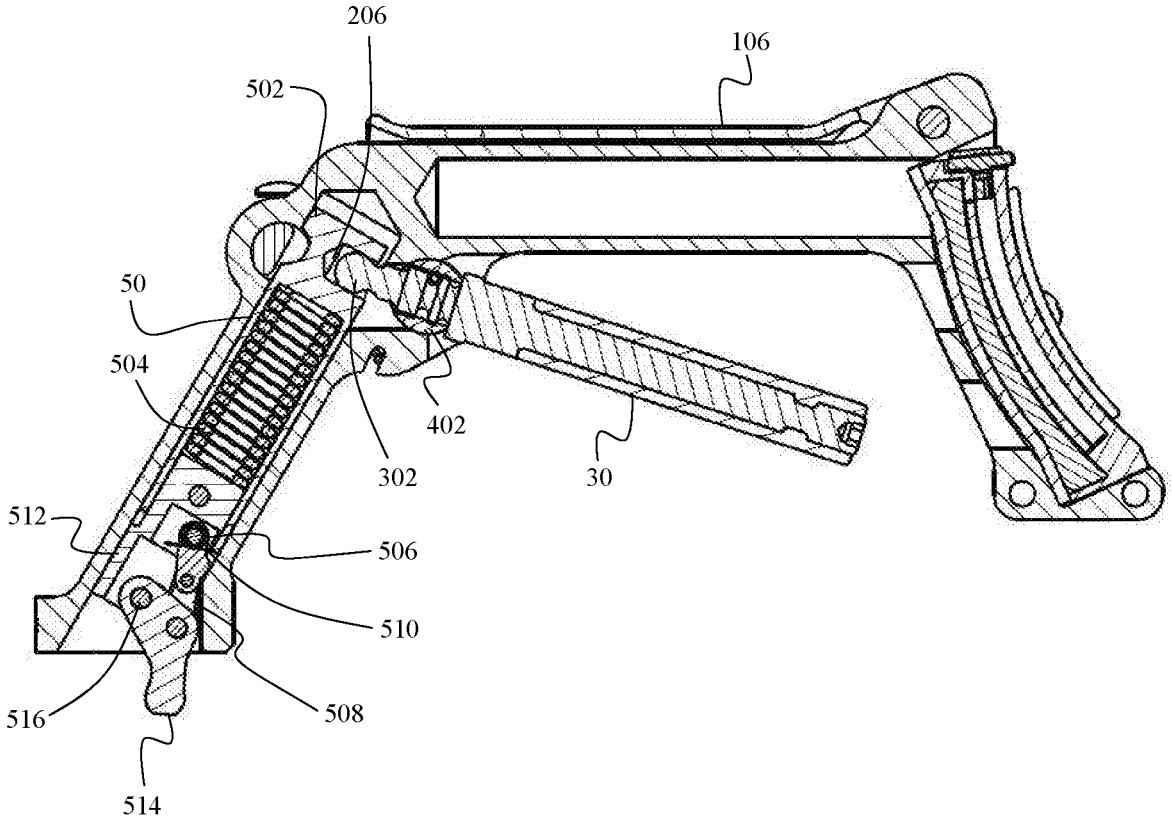
FIG. 3 is a cross sectional side view of the handle and firing mechanism assembly, according to an illustrative embodiment.

FIG. 3 is a cross sectional side view of the handle and firing mechanism assembly, according to an illustrative embodiment. The H&FMA 1 further comprises a trigger, a pivot assembly, a sear assembly and a selector assembly 20. The H&FMA 1 converts rotation of the trigger 30, aided by the pivot assembly, into linear translation of the sear assembly. The sear assembly, in turn, extends a firing pin forward into the breech of the cannon. The selector assembly 20 places the H&FMA 1 into one of the three modes by restricting the movement of the sear assembly and thereby the trigger.

The trigger 30 comprises a spherical tip 302 which is threaded through the pivot 402 and rests inside the sear assembly 50. A return spring 404 is compressed by the trigger 30 when engaged and provides a returning force to the trigger 30 upon being depressed. The spherical tip 302 reduces gouging and uneven wear experience by prior solutions.

Figure 4:
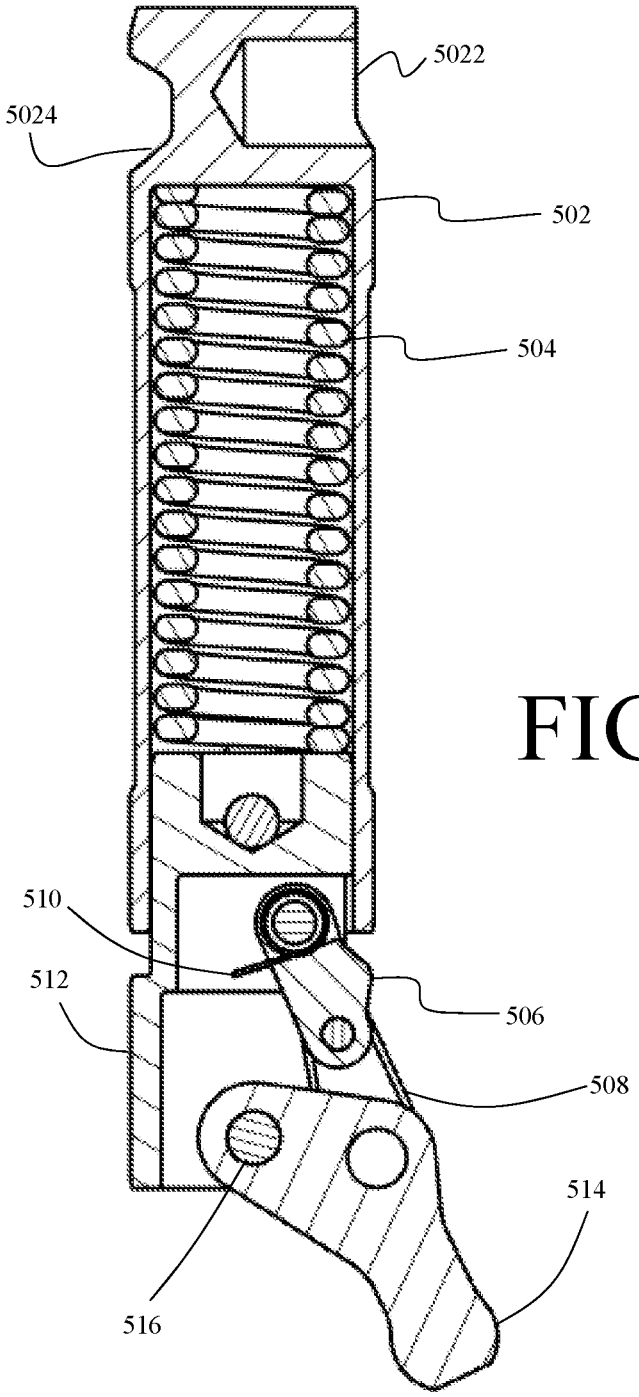
FIG. 4 cross sectional side view of a sear assembly of the handle and firing mechanism assembly, according to an illustrative embodiment.

FIG. 4 cross sectional side view of a sear assembly of the handle and firing mechanism assembly, according to an illustrative embodiment. The sear assembly 50 transfers rotational motion of the trigger 30 to insert the firing pin into the cannon. The sear assembly 50 further comprises a driver 502, a die spring 504, a first link 506, a second link 508, a torsion spring 510, a hammer 512 and a firing pin lever 514 rotatably fixed about a pivot pin 516.

The driver 502 comprises an opening near the top of the driver 502 and defined by the outer surface within which rests the spherical tip of the trigger. The driver 502 houses a preloaded compression die spring 504 within an interior cavity of the driver 502. The bottom of the die spring 504 is in contact with the hammer 512 which in turn is in contact with the first link 506 and the firing pin lever 514. The first link 506 and the second link 508 rest over center against the handle frame with the aid of a torsion spring 510.

Figure 5:
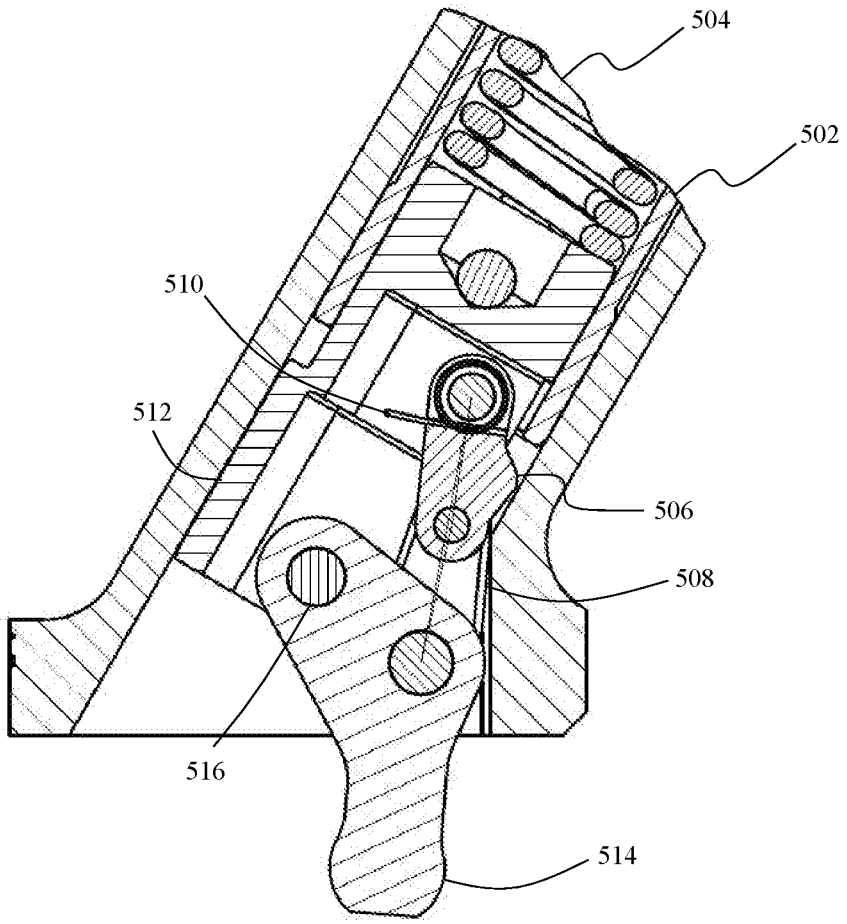
FIG. 5 is a close up cross sectional view of a portion of the sear assembly, according to an illustrative embodiment.

FIG. 5 is a close up cross sectional view of a portion of the sear assembly, according to an illustrative embodiment. When the trigger 30 is engaged, the trigger 30 engages the driver 502 to push it downward. The downward movement of the driver 502 further compresses the die spring 504. At a point along its downward trajectory, the driver 502 contacts the first link 506. The driver 502 pushes the first link 506 and the second link 508 inward which releases the hammer 512. The released hammer 512 is free to be thrust downward under the force of the die spring 504. The hammer 512 forces the firing pin lever 514 to pivot outward on fixed pivot pin 516 which drives the firing pin forward.

In trigger fire mode, releasing the trigger 30 allows the trigger spring 402 to pull back the firing pin and reset the sear assembly 50.

Figure 6:
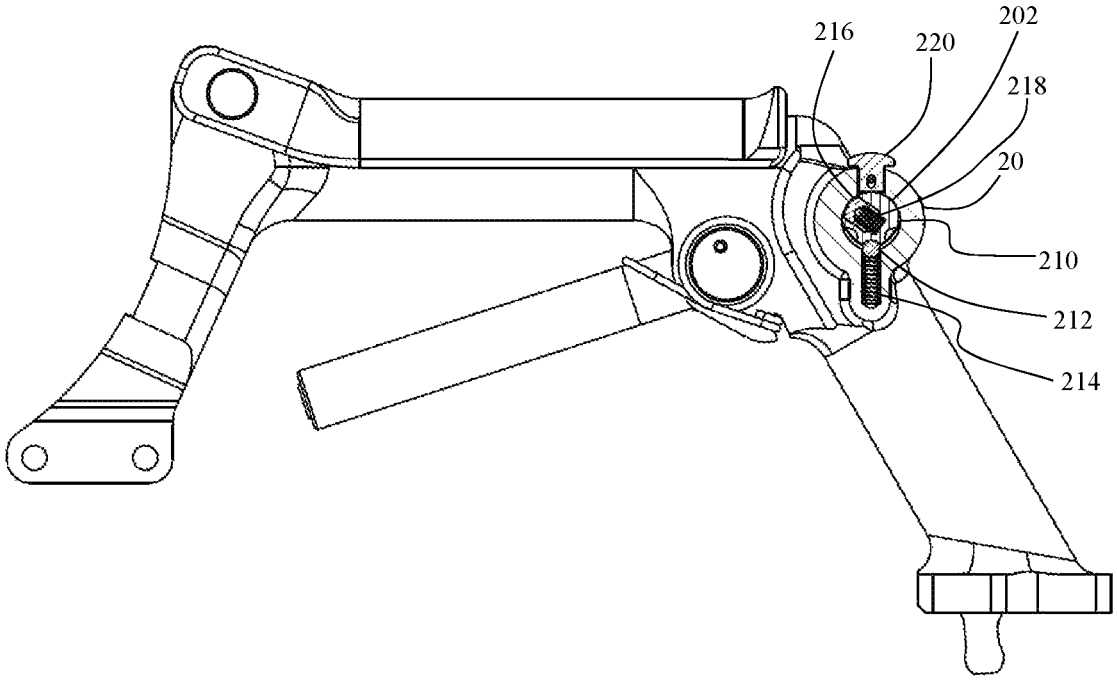
FIG. 6 is a side view of the handle and firing mechanism assembly with a partial cutaway showing a selector assembly, according to an illustrative embodiment.
Figure 7:
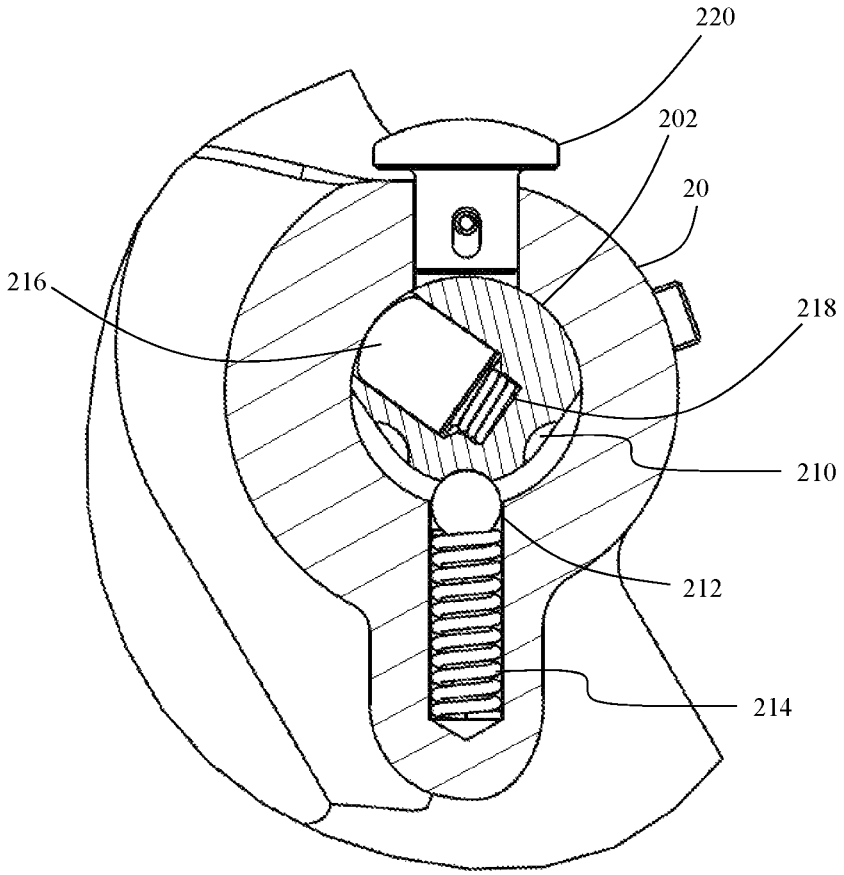
FIG. 7 is a cross sectional view of the selector assembly, according to an illustrative embodiment.

FIG. 6 is a side view of the handle and firing mechanism assembly with a partial cutaway showing a selector assembly, according to an illustrative embodiment. FIG. 7 is a cross sectional view of the selector assembly, according to an illustrative embodiment. The selector 202 has three (3) positions, Drop Fire "D" 204, Trigger Fire "T" 206 & Safe "S" 208. The selector 202 has a guide slot with spherical depressions 210 for each position which allow a detent ball 212 and spring 214 to hold the selector 202 in position.

When the selector 202 is rotated and placed into the "S" position 208, the selector 202 rides into a notch 5024 in the driver 502 of the sear assembly 50 and does not allow the trigger, 12, to be squeezed/fired. When the selector 202 is in the "T" position 206, the trigger 30 is allowed to rotate through a full firing sequence of being rotated into an engaged position and then released and rotated back to an initial position. Accordingly, sear assembly 50 is allowed to function when squeezing/firing the trigger 30 in trigger mode.

In drop fire mode, the trigger 30 is held in the engaged position and not allowed to be rotated back to its initial released position. To place the selector 202 into the "D" position 204 from the "T" position 206, the trigger 30 must be squeezed to trip the sear assembly 50. While still squeezing the trigger 30 rotate the selector 202 into the "D" position 204. This will also actuate the plunger 216 with spring 2018 and hard lock the selector 202 in position. This ensures that the selector 202 cannot rotate out of position during drop firing. To release, press captured button 220; Rotate selector 202 to "T" 206 then to "S" 208.

While the invention has been described with reference to certain embodiments, numerous changes, alterations and modifications to the described embodiments are possible without departing from the spirit and scope of the invention as defined in the appended claims, and equivalents thereof.

What is claimed is:

1. A handle and firing mechanism assembly for a mortar system capable of operating in a drop fire mode, a trigger fire mode and a safe mode, the handle and firing mechanism assembly comprising:

a handle housing;

a trigger protruding from the handle housing for receiving a rotational input from a user;

a pivot assembly comprising a pivot defining a hole extending through the pivot for receiving the trigger through and a trigger spring for biasing the trigger in an unrotated position;

a sear assembly engaged with the trigger for transferring a rotational translation of the trigger to a linear translation of a driver thereby causing a firing pin to protrude into a tube, the sear assembly further comprising a driver housing a pre-loaded die spring and defining an opening in an exterior surface within which a tip of the trigger rests;

a hammer in contact with an aft portion of the die spring and pushed downward upon a release of the die spring;

a firing pin lever pivoted outward by the downward moving hammer, the firing pin lever in contact with a firing pin such that when outwardly pivoted, the firing pin is driven forward; and a selector for placing the firing mechanism assembly in either the drop fire mode, the trigger fire mode or the safe mode by selectively restricting movement of the trigger wherein when the selector is placed in the drop fire mode, the selector is rotated to a position where the selector engages with a first feature of the driver such that the driver is restrained in a driven position.

2. The handle and firing mechanism assembly of claim 1 wherein when the selector is placed in the trigger fire mode, the trigger is able to rotate through a full firing sequence.

3. The handle and firing mechanism assembly of claim 2 wherein when the selector is placed in the trigger fire mode, the selector is rotated such that it does not interact with the sear assembly.

4. The handle and firing mechanism assembly of claim 1 wherein when the selector is placed in the drop fire mode, the firing pin lever is held in contact with the firing pin by the die spring.

5. The handle and firing mechanism assembly of claim 1 wherein when the selector is placed in a safe mode, the trigger is restricted from rotating.

6. The handle and firing mechanism assembly of claim 5 wherein when the selector is placed in a safe mode, the selector is rotated to a position in which the selector engages with a second feature of the driver such that the plunger is restricted from downward movement.

7. The handle and firing mechanism assembly of claim 1 wherein a rear base of the handle housing is fixably mounted to the tube.

8. The handle and firing mechanism assembly of claim 1 wherein the handle housing further comprises a tubular grip.

9. The handle and firing mechanism assembly of claim 1 wherein the trigger comprises a spherical tip.

10. The handle and firing mechanism assembly of claim 1 wherein the sear assembly further comprises a first link and a second link resting over center against the handle housing with the aid of a torsion spring, the first link and second link positioned within the sear assembly to restrain the hammer against a force of the die spring until the first link and the second link are pushed inward by the downward moving driver.

11. A handle and firing mechanism assembly for a mortar system capable of operating in a drop fire mode, a trigger fire mode and a safe mode, the handle and firing mechanism assembly comprising:

a handle housing comprising a tubular grip and having a rear base which is fixably mounted to a tube;

a trigger protruding from the housing and further comprising a trigger for receiving a rotational input from a user and comprising a spherical tip;

a pivot assembly comprising a pivot defining a hole extending through the pivot for receiving the trigger through and a trigger spring for biasing the trigger in an unrotated position;

a sear assembly engaged with the trigger for transferring a rotational translation of the trigger to a linear translation of a driver thereby causing a firing pin to protrude into the tube, the sear assembly further comprising a driver housing a pre-loaded die spring and defining an opening in an exterior surface within which the spherical tip of the trigger rests, a hammer in contact with an aft portion of the die spring and pushed downward upon a release of the die spring, a firing pin lever pivoted outward by the downward moving hammer, the firing pin lever in contact with a firing pin such that when outwardly pivoted, the firing pin is driven forward, and a first link and a second link resting over center against the handle housing with the aid of a torsion spring, the first link and second link positioned within the sear assembly to restrain the hammer against a force of the die spring until the first link and the second link are pushed inward by the downward moving driver; and a selector for placing the firing mechanism assembly in either the drop fire mode, the trigger fire mode or the safe mode by selectively restricting movement of the trigger wherein when the selector is placed in the drop fire mode, the selector is rotated to a position where the selector engages with a first feature of the driver such that the driver is restrained in a driven position.

12. The handle and firing mechanism assembly of claim 11 wherein when the selector is placed in the trigger fire mode, the trigger is able to rotate through a full firing sequence.

13. The handle and firing mechanism assembly of claim 12 wherein when the selector is placed in the trigger fire mode, the selector is rotated such that it does not interact with the sear assembly.

14. The handle and firing mechanism assembly of claim 11 wherein when the selector is placed in the drop fire mode, the firing pin lever is held in contact with the firing pin by the die spring.

15. The handle and firing mechanism assembly of claim 11 wherein when the selector is placed in a safe mode, the trigger is restricted from rotating.

16. The handle and firing mechanism assembly of claim 15 wherein when the selector is placed in a safe mode, the selector is rotated to a position in which the selector engages with a second feature of the driver such that the plunger is restricted from downward movement.

* * * * *